United States Patent [19]

Gullikson

[11] Patent Number: 4,553,666

[45] Date of Patent: Nov. 19, 1985

[54] SHIPPING AND DISPLAY CARTON WITH CUT PROTECTION FOR CONTENTS

[75] Inventor: Ralph G. Gullikson, Toledo, Ohio

[73] Assignee: Owens-Illinois, Inc., Toledo, Ohio

[21] Appl. No.: 697,606

[22] Filed: Feb. 4, 1985

[51] Int. Cl.[4] ..... B65D 5/54

[52] U.S. Cl. ..... 206/44 R; 206/620; 206/627; 229/16 D

[58] Field of Search ..... 229/16 D, 37 R, 6 R; 206/44 R, 45.12, 620, 622, 627, 629, 602

[56] References Cited

U.S. PATENT DOCUMENTS

| | | | |
|---|---|---|---|
| 2,675,913 | 4/1954 | Hanson | 206/45.12 |
| 2,812,852 | 11/1957 | Samuels | 206/44 R |
| 2,823,794 | 2/1958 | Garman | 206/44 R |
| 2,827,162 | 3/1958 | Garman | 206/44 R |
| 2,964,169 | 12/1960 | Brachman | 206/44 R |
| 3,185,382 | 5/1965 | Nunn | 206/44 R |
| 3,372,794 | 3/1968 | Kohlhaas | 206/620 X |
| 3,917,158 | 11/1975 | Dorofachuk | 206/620 X |
| 4,058,206 | 11/1977 | Morse et al. | 206/44 R |
| 4,350,281 | 9/1982 | Dornbusch et al. | 206/44 R |

FOREIGN PATENT DOCUMENTS

| | | | |
|---|---|---|---|
| 2223710 | 5/1972 | Fed. Rep. of Germany | 206/620 |
| 1561979 | 2/1969 | France | 206/620 |

*Primary Examiner*—William Price
*Assistant Examiner*—Gary E. Elkins
*Attorney, Agent, or Firm*—John R. Nelson

[57] ABSTRACT

A shipping and display carton for a plurality of plastic containers wherein the carton is formed from a flat blank that is folded into a slotted style container configuration with end flaps of sufficient size to effectively close the ends of the tubular configuration with a double thickness of corrugated board. A diagonal, perforated line is made in the underlying flaps and a diagonal cut designating line is marked on the overlying flaps. The cut designating line is also marked across the width of both the front panel and back panel joining the ends of the cut designating lines in the flaps. A small panel extends under the front panel cut designating line to protect the enclosed product. After the cut designating line has been cut, the carton is separated into two parts with the upper part discarded and the lower part serves as the display.

4 Claims, 3 Drawing Figures

SHIPPING AND DISPLAY CARTON WITH CUT PROTECTION FOR CONTENTS

BACKGROUND OF THE INVENTION

It has been the general practice to provide cartons for shipping a plurality of filled containers, either glass, plastic, paper or metal, where the cartons are opened at the store and the contents removed and put on display on shelves in the market. In some cases, where the bottled products are to be put on display in areas that are without shelves, such as aisles, it has been necessary to stack the bottles on sheets of corrugated board which are supported on the top of the array of bottles positioned therebeneath. These display stacks are, at best, unstable and may be easily upset with only a slight blow from a grocery cart or nudge from someone walking by the display.

It would seem desirable to have fairly substantial display arrangements and in fact several display systems are in use where fairly elaborate corrugated cartons that are knocked down and then reassembled in the store are available. These systems are time consuming for the store employees to assemble and then fill the display with the product being sold.

More recently there have been corrugated shipping containers that can be partially disassembled with the product being exposed after an outer cover member is removed. These systems all require a fairly large blank or blanks in order to permit the discard of a substantial portion of the carton while retaining a fairly rigid display rack.

SUMMARY OF THE INVENTION

The invention is a shipping carton which is easily severed into a display for a plurality of bottles wherein the bottles are protected from damage by case opening knives when the shipping carton is converted to a display holder and the carton is formed of a minimum of corrugated paperboard.

With the foregoing in view, it is an object of the present invention to provide a carton for both shipping and display purposes which is made of a minimum amount of corrugated board yet is sturdy enough to protect the containers, such as plastic bottles, during shipping and is easily converted to a display device.

It is a further object of this invention to provide a shipping carton for plastic bottles that may be easily severed into a display carton where the plastic bottles are protected from being cut when the carton is severed for opening and display purposes.

Other and further objects will be apparent from the following description taken in conjunction with the attached sheets of drawings.

DETAILED DESCRIPTION OF THE DRAWINGS

Figure 1:
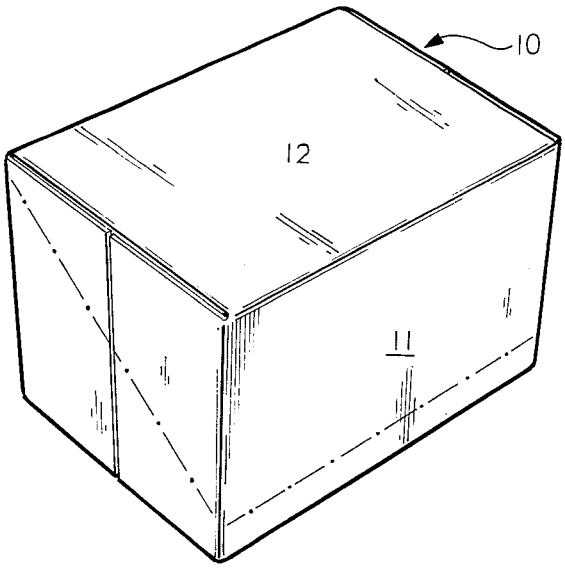
FIG. 1 is a perspective view of the shipping carton of the invention.
Figure 3:
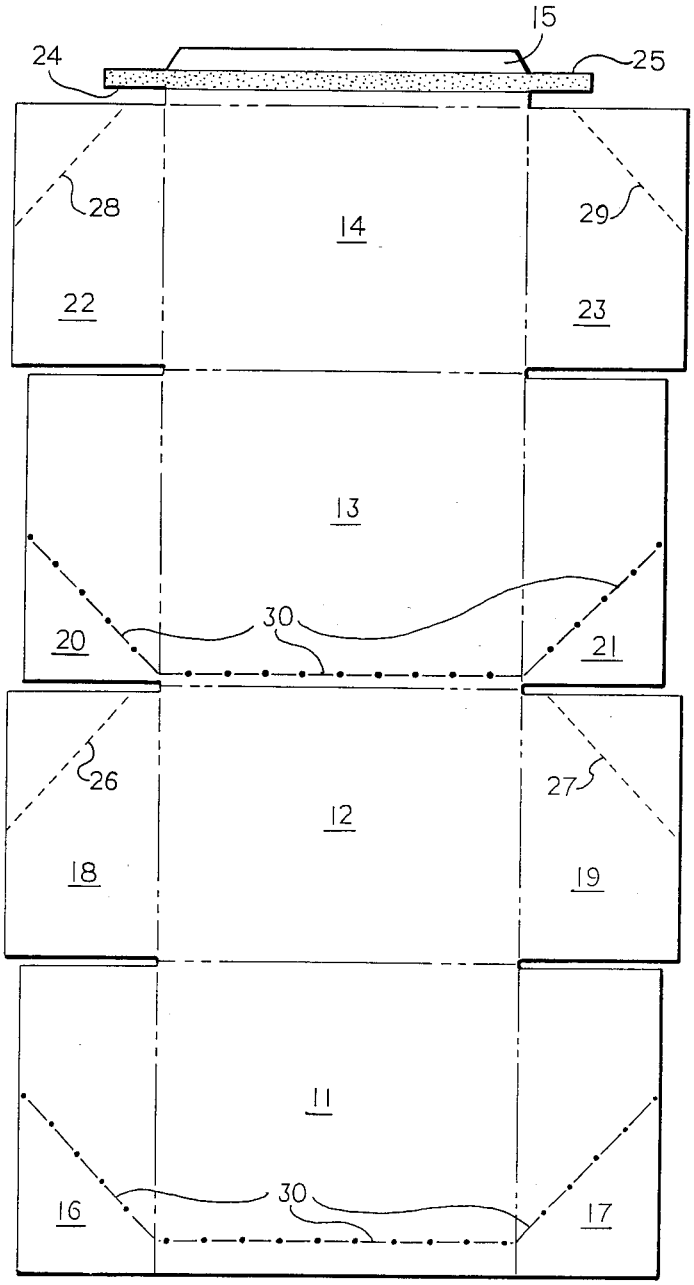
FIG. 3 is a plan view of the blank for the carton of FIG. 1.

With particular reference to the drawings, the shipping carton generally designated 10 in FIG. 1 is formed from the blank shown in detail in FIG. 3. The carton may be characterized generally as a slotted style container in that the back, front, top and bottom are all hingedly connected together and the closing flaps are formed at the sides of the main panels.

A main panel 11, which may be termed the front panel, is rectangular in shape and has its upper edge hingedly connected to a rectangular top panel 12 which in turn is hingedly connected at one edge to a rectangular back panel 13 of the same size as the front panel. Another edge of the back panel opposite the one edge is hingedly connected to a bottom panel 14 of the same size as the top panel. The opposite side of the bottom panel is hingedly connected to a partial panel 15. The partial panel 15 actually serves as a glue tab for forming the four panels 11-14 into a tubular configuration. The panel 15 also is long enough so that when it is glued to the inside surface of the lower part of the front panel it will provide a double thickness of corrugated board at the lower part of the front panel.

Each of the panels 11-15 is formed with a pair of flaps hingedly attached to the ends or sides thereof as shown in FIG. 3. The front panel 11 carries a pair of flaps 16 and 17 connected thereto and top panel 12 carries flaps 18 and 19 hinged to the free edges of the panel. The back panel 13 carries flaps 20 and 21 and bottom panel 14 has flaps 22 and 23 hinged thereto. As best shown in FIG. 3, the partial panel 15 also has a pair of flaps 24 and 25 hinged to the opposite ends of the panel.

About one-half of the panel 15 and both of the attached flaps 24 and 25 have glue applied thereto with the glue on the panel being generally confined to the one-half thereof that is adjacent the hinged connection to the bottom panel 14. Thus it can be seen that when the panels are formed into a tubular configuration, the partial panel underlies the lower part of front panel 11.

With the tubular configuration glued by the panel 15, it is convenient to load an array of plastic bottles, for example catsup bottles, into the open end of the carton.

It should be noted that flaps 18 and 22 or flaps 19 and 23 are first folded down and up respectively. These flaps on either end are of such a width that when folded toward each other they will essentially fill the opening. The flaps 22 and 23 when folded toward each other are intended to overlap the glued flaps 24 and 25 and be glued thereto.

Flaps 16 and 20 and 17 and 21 may then be closed over and glued to the faces of the flaps 18, 22 and 19, 23. This completes the erection of the carton 10 with the product enclosed ready for shipping. Obviously, the one side or end of the carton may be completely formed before the bottles are placed inside the tubular configuration. There are presently on the market bottle assembly machines which will assemble an array of bottles, in for example, a three deep and four wide configuration and slide them into the automatically erected tubular series of panels. The application of glue can also be carried out during the erection of the carton.

The significance of the present carton becomes apparent when it is understood that the flaps 18, 19, 22 and 23 are formed with perforated lines 26, 27, 28 and 29 therein, respectively. These perforated lines are sufficiently strong to hold their flaps together during shipping when the flaps are glued to the overlying flaps.

As best shown in FIG. 3 and as also illustrated in FIG. 1, the carton blank is marked with a cut designating line 30 on the outside thereof. The cut designating line 30 is shown in the drawing as a series of small circles and dashes.

It is intended that after the carton with its enclosed array of bottles has arrived at the market, that the carton be cut with a razor blade in a holder with a depth guide which will permit the operator to cut only one board thickness along the cut designating line 30.

When the cut designating line 30 has been followed across the front panel 11, up the flaps 17 and 21, across the back panel 13 and then down the flaps 20 and 16 to the front panel, the carton will have been, in effect, cut in half, the only thing holding the two halves together being the perforated flaps 18, 19, 22 and 23 that are glued to the inside of the outer flaps 16, 17, 20 and 21.

Figure 2:
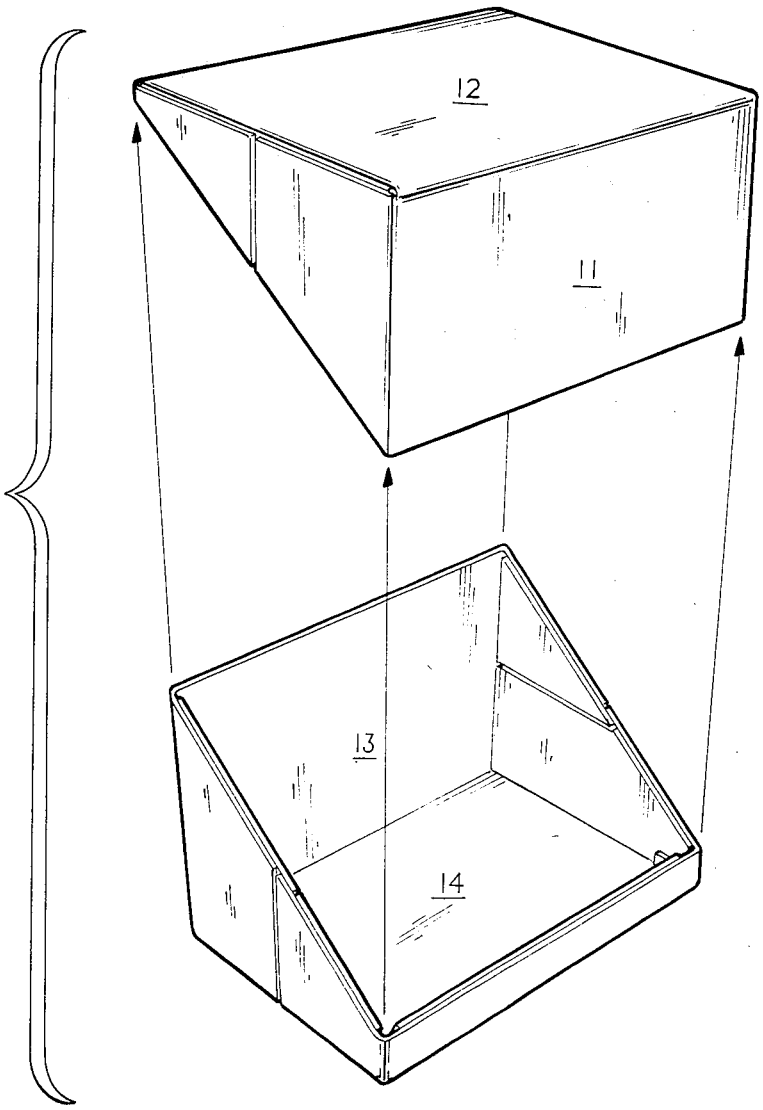
FIG. 2 is an exploded perspective view of the carton of FIG. 1 after severance of the upper portion.

When the carton is erected, the cut designating line 30 on the outside flaps is in registry with the perforated lines 26, 27, 28 and 29 so that once the cut has been completed, the operator needs to hit the overlying flap ends of the carton to separate the inner flaps and permit the upper half of the carton, including the top panel 12 and much of front panel 11, to be separated from the bottom half, as shown in FIG. 2.

The function of the partial panel 15 comes into play during the cutting of front panel 11 in that the non-glue bearing portion or upper portion of the panel 15 underlies the cut designating line 30 on the front panel. Thus the panel 15 protects the bottles that are in behind the front panel. When the cut designating line 30 has been followed and the carton separated, the two glue flaps 24 and 25, which have been glued to the lower inside of the flaps 22 and 23, give rigidity to the small corners of the front panel that remains with the display portion of the carton. The glue panel 15 and the lower edge of panel 11 thus become a low vertical lip to help retain the bottles in their assembled position in an upright attitude on the bottom panel.

The bottles are protected on the sides by the fact that the cut designating line 30 in the flaps is over the top of a thickness of board formed by the flaps with the score line. The cut designating line 30 at the back panel is indicated as being just below the top edge and the bottles will normally have their tops below the level of the cut line. Furthermore, the bottles, if they are plastic, will usually have fairly heavy closures and they will not normally be of a larger diameter than the bottles. Even so, they are certainly less subject to being cut into than the blown side wall or bottom of the bottle.

It can thus be seen that applicant has provided a carton which meets the criteria set forth in the objects of the invention, in that it is made of a minimum amount of corrugated board and is configured so that it can be handled through fairly conventional wrap-around carton erecting, assembling and sealing apparatus.

Furthermore, the carton after shipping can be easily severed with the upper half being discarded and the lower half serving as a display carton.

While the carton shown and described in detail has been described as used in shipping plastic bottles, it could be used to ship and later serve as a display for glass bottles or containers formed from other materials, such as folding cartons made of paper or plastic.

The particularly described carton shows the flaps 18, 19, 22 and 23 as being the underlying flaps with the perforated lines. It should be apparent that the flaps 16, 17, 20 and 21 could be the underlying flaps and have perforated lines in place of the cut designating lines, while the other flaps would carry the cut designating lines in place of the perforated lines.

As a matter of fact, the flaps that are hinged to a particular panel need not both be either an outside or underlying flap. The only requirement is that those flaps which are to be underlying have the perforated line while the outside flaps have the cut designating lines.

Having described the best mode contemplated for carrying out the invention, applicant should not be limited thereby but be afforded the scope of coverage commensurate with the appended claims

What is claimed:

1. A display and shipping carton comprising a front, a top, a back and a bottom panel foldably connected together to form a tubular configuration with open ends, a partial panel connected to said bottom panel and glued to the inside of said front panel at the bottom thereof, a flap foldably connected to the ends of each front, top, back and bottom panel, said flaps being folded over to close said open ends of the tubular configuration with outside flaps being glued to underlying flaps to form closed ends of double wall thickness, a horizontal cut designating line marked across said front panel at a location overlying said partial panel, a horizontal cut designating line marked across the back panel at a position adjacent the top thereof, and diagonal, cut designating lines marked across the outside flaps extending from the ends of the cut designating line on the front panel to the end of the cut designating line on the back panel, and a diagonal perforated line in said underlying flaps in exact underlying registry with the cut designating lines in the outside flaps.

2. The carton of claim 1 further including a pair of flaps connected to the ends of said partial panel and glued against the inside of the flaps that are attached to the front panel of said tubular configuration.

3. A carton for shipping and for severance into a display package comprising a front, a top, a back, and a bottom panel all foldably connected together to form a tubular configuation, a partial panel foldably connected to said bottom panel, and underlying the lower edge of the front panel, said partial panel being glued to the front panel along a narrow band at the bottom of said front panel, a first pair of flaps connected to the top panel and a second pair of flaps connected to said bottom panel for closing the ends of the tubular configuration, a third pair of flaps connected to the front panel and a fourth pair of flaps connected to the back panel and adapted to be folded to overlie the first and second pairs of flaps, a perforated line formed in said first flaps and extending from the rear edge thereof at a point slightly below the connection to said top panel in a straight line to the middle of the edge of said first flap opposite said connection, a similar perforated line in said second flaps and extending from the front edge thereof at a point spaced above the connection to the bottom panel in a straight line to the middle of the edge of said second flaps opposite said connection, a printed cut designating line extending horizontally across the front panel slightly above the glue area of the partial panel and horizontally across the back panel slightly below the top edge, and printed cut designating lines on the folded third and fourth flaps joining the ends of the cut designating lines on the front and back panels.

4. The carton of claim 3 wherein the pair of flaps connected to the ends of said partial panel are glued to the inside of the third pair of flaps when folded to close said tubular configuration.

* * * * *